US011769478B1

(12) United States Patent
Lubberhuizen et al.

(10) Patent No.: US 11,769,478 B1
(45) Date of Patent: Sep. 26, 2023

(54) DIGITAL SIGNAL PROCESSING SYSTEM

(71) Applicant: Dialog Semiconductor B.V., s-Hertogenbosch (NL)

(72) Inventors: Wessel Harm Lubberhuizen, Delden (NL); Johannes Steensma, Satellite Beach, FL (US)

(73) Assignee: Dialog Semiconductor B.V., 's-Hertogenbosh (NL)

( * ) Notice: Subject to any disclaimer, the term of this patent is extended or adjusted under 35 U.S.C. 154(b) by 134 days.

(21) Appl. No.: 17/376,959

(22) Filed: Jul. 15, 2021

(51) Int. Cl.
*G10K 11/178* (2006.01)

(52) U.S. Cl.
CPC ..... *G10K 11/17855* (2018.01); *G10K 2210/1081* (2013.01); *G10K 2210/3012* (2013.01); *G10K 2210/3051* (2013.01)

(58) Field of Classification Search
CPC ..... G10K 11/17855; G10K 2210/1081; G10K 2210/3012; G10K 2210/3051
See application file for complete search history.

(56) References Cited

U.S. PATENT DOCUMENTS

| | | | | |
|---|---|---|---|---|
| 7,398,289 | B2 | 7/2008 | Visalli et al. | |
| 8,554,568 | B2 | 10/2013 | Liebchen | |
| 10,699,721 | B2 | 6/2020 | Seroussi et al. | |
| 2005/0010632 | A1 | 1/2005 | Lei et al. | |
| 2005/0065991 | A1* | 3/2005 | Visalli | G06F 7/4876 708/620 |

OTHER PUBLICATIONS

Wikipedia, "Q (number format)," Retrieved from "https://en.wikipedia.org/w/index.php?title=Q_(number_format)&oldid=1011412322", This page was last edited on Mar. 10, 2021, at 19:14 (UTC), 5 pages.
Wikipedia, "Digital filter," Retrieved from "https://en.wikipedia.org/w/index.php?title=Digital_filter&oldid=1020094029", This page was last edited on Apr. 27, 2021, at 03:52 (UTC), 9 pages.
Wikipedia, "Digital biquad filter," Retrieved from "https://en.wikipedia.org/w/index.php?title=Digital_biquad_filter&oldid=897689326", This page was last edited on May 18, 2019, at 18:14 (UTC), 6 pages.
DSP Related.com, Coupled-Form 2nd-Order IIR Resonators: A Contradiction Resolved—Rick Lyons, found Jul. 12, 2021: https://www.dsprelated.com/showarticle/183.php, 7 pages.
Wikipedia, "Floating-point arithmetic," Retrieved from "https://en.wikipedia.org/w/index.php?title=Floating-point_arithmetic&oldid=1019727651", This page was last edited on Apr. 25, 2021, at 02:19 (UTC), 25 pages.
"The Implementation of Recursive Digital Filters for High-Fidelity Audio*," by Jon Dattorro, J. Audio Eng. Soc., vol. 36, No. 11 , Nov. 1968, 32 pages.

* cited by examiner

*Primary Examiner* — David L Ton
(74) *Attorney, Agent, or Firm* — Saile Ackerman LLC; Stephen B. Ackerman

(57) ABSTRACT

A digital signal processing system for multiplying a digital value and a digital signal. The digital signal processing system receives the digital value in an encoded format, and multiplies the digital value with the digital signal. The digital value in the encoded format has an offset, which is encoded as a floating point. The disclosure provides a digital processing system that can carry out a multiplication operation with a smaller area, less complexity and/or reduced power usage compared with known multipliers.

21 Claims, 8 Drawing Sheets

```
SignFrac = 0:
Exp=0  0.mmmmmmmmmmmmmmmmmmmm  q0.20
Exp=1  0.01mmmmmmmmmmmmmmmmm   q0.19
Exp=2  0.001mmmmmmmmmmmmmmmmm
Exp=3  0.0001mmmmmmmmmmmmmmmmm
Exp=4  0.00001mmmmmmmmmmmmmmmmm
Exp=5  0.000001mmmmmmmmmmmmmmmmm
Exp=6  0.0000001mmmmmmmmmmmmmmmmm
Exp=7  0.00000001mmmmmmmmmmmmmmmmm
Exp=8  0.000000001mmmmmmmmmmmmmmmmm
Exp=9  0.0000000001mmmmmmmmmmmmmmmmm
Exp=10 0.00000000001mmmmmmmmmmmmmmmmm
Exp=11 0.000000000001mmmmmmmmmmmmmmmmm
Exp=12 0.0000000000001mmmmmmmmmmmmmmmmm
Exp=13 0.00000000000001mmmmmmmmmmmmmmmmm
Exp=14 0.000000000000001mmmmmmmmmmmmmmmmm
Exp=15 0.000000000000000mmmmmmmmmmmmmmmmm  q0.32
```

```
SignFrac = 1:
Exp=0  1.mmmmmmmmmmmmmmmmmmmm  q0.20
Exp=1  1.10mmmmmmmmmmmmmmmmm   q0.19
Exp=2  1.110mmmmmmmmmmmmmmmmm
Exp=3  1.1110mmmmmmmmmmmmmmmmm
Exp=4  1.11110mmmmmmmmmmmmmmmmm
Exp=5  1.111110mmmmmmmmmmmmmmmmm
Exp=6  1.1111110mmmmmmmmmmmmmmmmm
Exp=7  1.11111110mmmmmmmmmmmmmmmmm
Exp=8  1.111111110mmmmmmmmmmmmmmmmm
Exp=9  1.1111111110mmmmmmmmmmmmmmmmm
Exp=10 1.11111111110mmmmmmmmmmmmmmmmm
Exp=11 1.111111111110mmmmmmmmmmmmmmmmm
Exp=12 1.1111111111110mmmmmmmmmmmmmmmmm
Exp=13 1.11111111111110mmmmmmmmmmmmmmmmm
Exp=14 1.111111111111110mmmmmmmmmmmmmmmmm
Exp=15 1.1111111111111111mmmmmmmmmmmmmmmmm  q0.32
```

*FIG. 3B*

DIGITAL SIGNAL PROCESSING SYSTEM

TECHNICAL FIELD

The present disclosure relates to a digital signal processing system. In particular the present disclosure relates to a digital signal processing system for multiplying a digital value and a digital signal.

BACKGROUND

High performance active noise cancellation systems use low latency noise cancelling filters. They are typically implemented using digital signal processors that process data streams at an oversampled rate, i.e. larger than 2× the required audio bandwidth. Increasing the bandwidth in this way results in an increase in the cut-off frequency and transition bandwidth of the low pass filters.

A higher sampling rate, as achieved by oversampling, results in a lower latency, but also requires more operations per second, leading to increased power consumption. Furthermore, achieving higher sample rates generally requires higher coefficient precision, which requires higher precision multipliers for implementation of the noise cancelling filters. Higher precision multipliers require a larger area, have greater complexity, and greater power requirements than lower precision alternatives.

A common practice for avoiding the need for the higher precision multipliers is to use alternative filter topologies, such as coupled form IIR resonators. A disadvantage of coupled form IIR resonators is that they require more multiplication operations, again resulting in larger area, more complexity and higher power usage.

SUMMARY

It is desirable to provide a digital processing system that can carry out a multiplication operation with a smaller area, less complexity and/or reduced power usage compared with known multipliers.

Furthermore, it is desirable to provide a digital processing system that functions as a low latency noise cancelling filter for active noise cancellation applications, where the noise cancelling filter performs a multiplication operation and has a smaller area, less complexity and/or reduced power usage compared with known noise cancelling filters performing the same or similar multiplication operation.

According to a first aspect of the disclosure there is provided a digital signal processing system for multiplying a digital value and a digital signal, the digital signal processing system configured to receive the digital value in an encoded format, and multiply the digital value with the digital signal, wherein the digital value in the encoded format comprises an offset, the offset being encoded as a floating point.

Optionally, the digital value in the encoded format comprises twenty four bits.

Optionally, a base of the floating point is two.

Optionally, the floating point comprises a fractional part and an exponent.

Optionally, the fractional part comprises a sign bit and a mantissa.

Optionally, the exponent comprises four bits, and/or the fractional part comprises twenty bits.

Optionally, the digital value in the encoded format comprises an integer.

Optionally, the integer comprises two bits.

Optionally, the floating point comprises a fractional part and an exponent, and the exponent comprises four bits and/or the fractional part comprises eighteen bits.

Optionally, the digital signal processing system comprises a decoding circuit configured to i) receive the digital value in the encoded format, and ii) decode the digital value prior to multiplication, and a multiplication circuit configured to i) receive the digital value in a decoded format, and ii) to multiply the digital value in the decoded format with the digital signal.

Optionally, the floating point comprises a fractional part and an exponent.

Optionally, the digital value in the encoded format comprises an integer.

Optionally, the decoding circuit is configured to provide the digital value in the decoded format by providing a first component comprising the integer in the decoded format, a second component comprising the fractional part in the decoded format, and a third component comprising the exponent in the decoded format.

Optionally, the multiplication circuit comprises a first multiplier configured to receive the first component and the digital signal, a second multiplier configured to receive the second component and the digital signal, and a shifter circuit configured to receive the third component.

Optionally, the multiplication circuit comprises an addition circuit, wherein the first multiplier is configured to multiply the first component and the digital signal and to provide a first output to the addition circuit, the second multiplier is configured to multiply the second component and the digital signal and to provide a second output to the shifter circuit, the shifter circuit is configured to shift the second output using the third component and to provide a third output to the addition circuit, and the addition circuit is configured to add the first output and the third output to provide a fourth output, the fourth output being the multiplication of the digital value and the digital signal.

Optionally, the digital signal comprises thirty two bits.

Optionally, the digital signal processing system comprises a memory element configured to store the digital value in the encoded format.

Optionally, the digital signal processing system is configured to processes digital signal at an oversampled rate.

According to a second aspect of the disclosure there is provided a multiply accumulate unit comprising a digital signal processing system for multiplying a digital value and a digital signal, the digital signal processing system configured to receive the digital value in an encoded format, and multiply the digital value with the digital signal, wherein the digital value in the encoded format comprises an offset, the offset being encoded as a floating point.

It will be appreciated that the multiply accumulate unit of the second aspect may include features set out in the first aspect and can incorporate other features as described herein.

According to a third aspect of the disclosure there is provided an active noise cancellation system comprising a digital signal processing system configured as a noise cancelling filter, the digital signal processing system for multiplying a digital value and a digital signal, the digital signal processing system configured to receive the digital value in an encoded format, and multiply the digital value with the digital signal, wherein the digital value in the encoded format comprises an offset, the offset being encoded as a floating point.

Optionally, the digital signal is an audio signal.

Optionally, the active noise cancellation system is implemented within a headset.

It will be appreciated that the active noise cancellation system of the third aspect may include features set out in the first aspect and/or second aspect and can incorporate other features as described herein.

According to a fourth aspect of the disclosure there is provided a method for multiplying a digital value and a digital signal using a digital signal processing system, the method comprising receiving the digital value in an encoded format using the digital signal processing system, and multiplying the digital value with the digital signal using the digital signal processing system, wherein the digital value in the encoded format comprises an offset, the offset being encoded as a floating point.

It will be appreciated that the method of the fourth aspect may include features set out in the first, second and/or third aspects and can incorporate other features as described herein.

According to a fifth aspect of the disclosure there is provided a method of providing a multiply accumulate unit comprising a digital signal processing system for multiplying a digital value and a digital signal, the digital signal processing system configured to receive the digital value in an encoded format, and multiply the digital value with the digital signal, wherein the digital value in the encoded format comprises an offset, the offset being encoded as a floating point.

It will be appreciated that the method of the fifth aspect may include features set out in the first, second, third and/or fourth aspects and can incorporate other features as described herein.

According to a sixth aspect of the disclosure there is provided a method of providing an active noise cancellation system comprising a digital signal processing system configured as a noise cancelling filter, the digital signal processing system for multiplying a digital value and a digital signal, the digital signal processing system configured to receive the digital value in an encoded format, and multiply the digital value with the digital signal, wherein the digital value in the encoded format comprises an offset, the offset being encoded as a floating point.

It will be appreciated that the method of the sixth aspect may include features set out in the first, second, third, fourth and/or fifth aspects and can incorporate other features as described herein.

BRIEF DESCRIPTION OF THE DRAWINGS

The disclosure is described in further detail below by way of example and with reference to the accompanying drawings, in which:

FIG. 3A shows examples of an encoded format for the digital value and FIG. 3B illustrates how the bits forming the offset is decoded;

DESCRIPTION

Figure 1A:
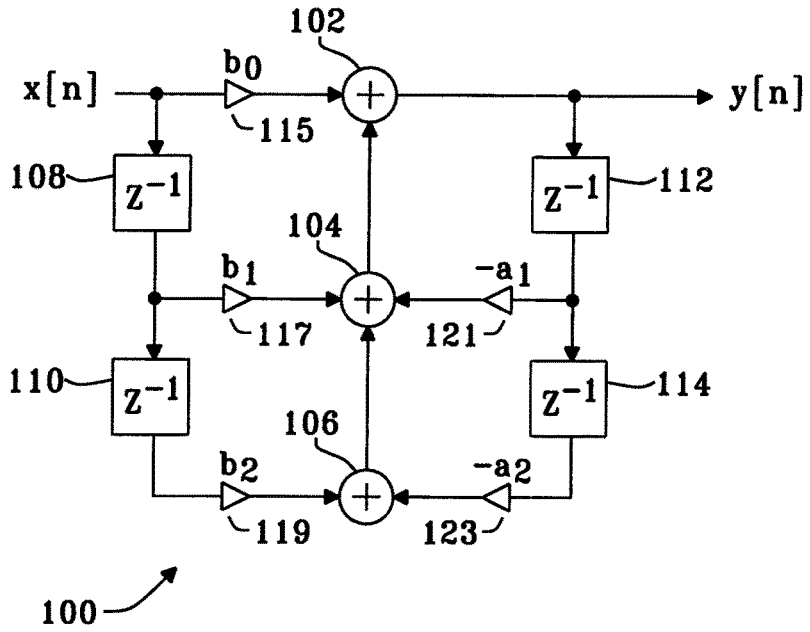
FIG. 1A Prior Art
FIG. 1A is a prior art schematic of a biquadratic section and FIG. 1B is a schematic of a quadratic section with normalised $b_1$ and $b_2$ multiplication.

FIG. 1A is a schematic of a biquadratic section 100 (Flowchart of a digital biquad filter by Akilaa, en.wikipedia.org/wiki/Digital_biquad_filter). The biquadratic section 100 comprises addition circuits 102, 104, 106; delay circuits 108, 110, 112, 114; and multiplication circuits 115, 117, 119, 121, 123. The biquadratic section 100 receives an input signal x[n] and provides an output signal y[n]. Also shown are coefficients $a_1$, $a_2$, $b_0$, $b_1$, $b_2$.

Oversampled filters have poles and zeros at frequencies that are much lower than the sampling rate. When these filters are implemented using cascaded or parallel low-order filter sections, the filter coefficients tend to be close to integer values. The distance to the integer value becomes smaller when the ratio between critical frequency and sampling rate is lower.

The observed behaviour can be analysed using a single biquadratic section, such as the biquadratic section 100 shown in FIG. 1(*a*). The z-domain transfer function of the biquadratic section is:

$$H(z) = \frac{b_0 + b_1 z^{-1} + b_2 z^{-2}}{1 + a_1 z^{-1} + a_2 z^{-2}} \tag{1}$$

Alternatively, the transfer function of a biquadratic section can be expressed in terms of a gain g, a pole $p=p_r+ip_i$ and a zero $q_4=q_r+iq_i$:

$$H(z) = g\frac{(z-q)(z-\bar{q})}{(z-p)(z-\bar{p})} = g\frac{1-2\mathrm{Re}(q)z^{-1}+|q|^2 z^{-2}}{1-2\mathrm{Re}(p)z^{-1}+|p|^2 z^{-2}} \tag{2}$$

To study the real-world transfer function of systems using oversampled filters, it is appropriate to use the s-domain instead of the z-domain representation, because the s-domain transfer function is independent from the sampling rate.

The z-domain and the s-domain are related by:

$$z = e^{\frac{s}{f_s}} \tag{3}$$

where $f_s$ is the sampling rate. For highly oversampled filters, we can relate the z-domain pole and zero locations $p_z$, $q_z$ to s-domain locations $p_s$, $q_s$ using:

$$p_z \approx 1 + \frac{p_s}{f_s} \tag{4}$$

$$q_z \approx 1 + \frac{q_s}{f_s} \tag{5}$$

Using these relations, we can find approximations for the z-domain filter coefficients that implement a given combination of s-domain pole $p_s$ and zero $z_s$:

$$\hat{b}_1 \approx -2 - \frac{\mathrm{Re}(q_s)}{f_s} \tag{6}$$

$$\hat{b}_2 \approx 1 + \frac{2\mathrm{Re}(q_s)}{f_s} + \frac{|q_s|^2}{f_s^2} \tag{7}$$

$$a_1 \approx -2 - \frac{\mathrm{Re}(p_s)}{f_s} \tag{8}$$

$$a_2 \approx 1 + \frac{2\mathrm{Re}(p_s)}{f_s} + \frac{|p_s|^2}{f_s^2} \tag{9}$$

Note that we are using normalized $b_1$, $b_2$ coefficients, $$\hat{b}_i = \frac{b_i}{b_0}.$$

The division by $b_0$ is compensated by a gain $g=b_0$.

Figure 1B:
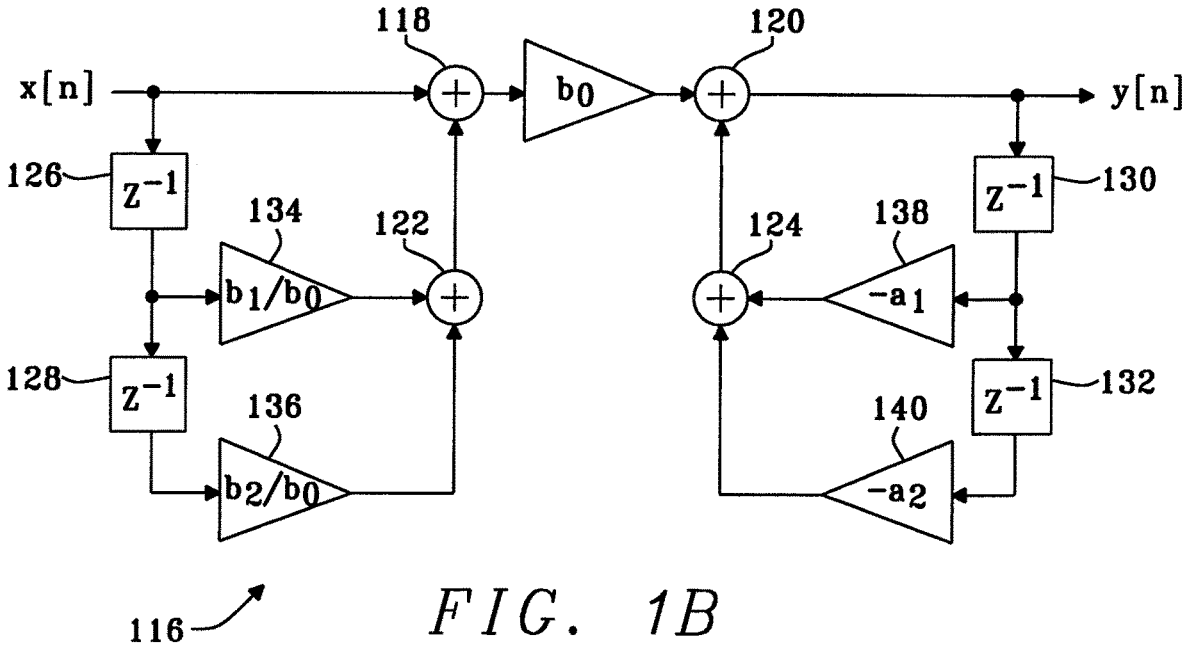

FIG. 1B is a schematic of a biquadratic section 116 with normalised $b_1$ and $b_2$ multiplication. Note that the total number of multiplications in FIG. 1B is the same as that in FIG. 1A. The biquadratic section comprises addition circuits 118, 120, 122, 124; delay circuits 126, 128, 130, 132; and multiplication circuits 134, 136, 138, 140, 142.

When $f_s >> |p_s|$ and $f_s >> |q_s|$ the coefficients can be represented as the sum of an integer $k \in \{-2, +1\}$ and a fraction $S\delta$ that is much smaller than 1. The coefficient multiplication may be provided by the separate product terms:

$$\hat{b}_i x_i = (l_i + \epsilon_i)x = l_i x + \epsilon_i x \tag{10}$$

$$a_i y_i = (k_i + \delta_i)y = k_i y + \delta_i y \tag{11}$$

In order cover a wide dynamic range of values, the fractions $\delta_i$, $\epsilon_i$ may be encoded as floating-point numbers, for example:

$$\delta_i = \text{significand}_i \times \text{base}^{exponent_i} \tag{12}$$

It should be noted that the significand may alternatively be referred to as the fractional part.

For a hardware implementation, where the binary number system is used, the base may be equal to 2, so that factor $\text{base}^{exponent} = 2^{exponent}$ can be realized efficiently using an arithmetic shifter. The fractional part may be split into a sign bit and a mantissa.

Figure 2:
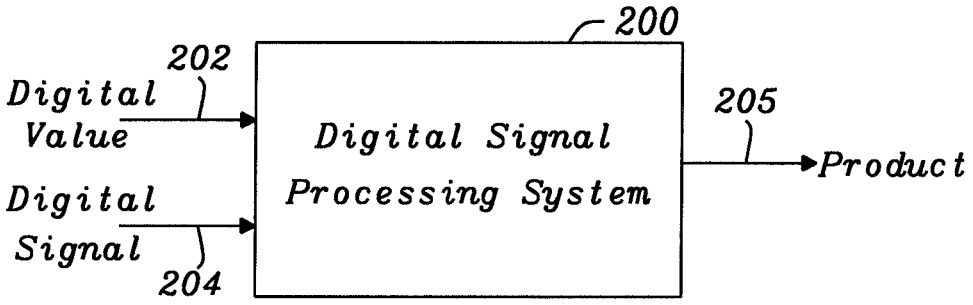
FIG. 2 is a schematic of a digital signal processing system for multiplying a digital value and a digital signal in accordance with a first embodiment of the present disclosure.

FIG. 2 is a schematic of a digital signal processing system 200 for multiplying a digital value 202 and a digital signal 204 in accordance with a first embodiment of the present disclosure. The digital signal processing system 200 is configured to receive the digital value 202 in an encoded format, and to multiply the digital value 202 with the digital signal 204. The digital value 202 in the encoded format comprises an offset, where the offset is encoded as a floating point. A product 205 of the multiplication of the digital value 202 and 204 may be provided by the digital signal processing system 200.

The digital value 202 in the encoded format may comprise an integer. It will be appreciated that the integer may be equal to zero, or any other fixed value. Where the integer is equal to zero, or has another fixed value, the bit or bits of the digital value 202 that would otherwise be used for storing the integer, may alternatively be used to provided an additional bit, or bits, for the offset.

The digital value 202 may be understood with reference to equations (10), (11) and (12). Specifically, with reference to equation (11) $a_i$ denotes a coefficient and may correspond to the digital value 202. In its encoded format, the digital value 202 may comprise the integer (which may correspond to $k_i$) and the offset (which may correspond to Si and as such may be referred to as the delta coefficient.). With reference to equation (11), y may correspond to the digital signal 204, and the offset is represented by a floating point, with an example being provided by equation (12).

The digital signal processing system 200 may be configured to processes the digital signal 204 at an oversampled rate. The digital value 202 in the encoded format may comprise twenty four bits. The digital signal 204 may comprise thirty two bits.

The floating point may comprise a fractional part and an exponent, as may be understood with reference to equation (12). As such, the digital value 202 will include a bit, or a portion of bits, representing the fractional part, and another bit, or another portion of bits, representing the exponent.

The base may be two, to enable efficient multiplication using an arithmetic shifter. A bit, or bits, representing the base may be omitted from the digital value 202, as the base for the required calculation may otherwise by provided, or may be implicit due to the binary format of the digital value 202.

The fractional part may comprise a sign bit and a mantissa. The exponent may comprise four bits. The integer may comprise two bits. The fractional part may comprise eighteen bits (with, for example, one bit for the sign bit and seventeen bits for the mantissa).

In a further embodiment, where the integer has a fixed value such as zero, the bits representing the integer may be omitted. In such an embodiment, the exponent may comprise four bits and/or the fractional part may comprise twenty bits.

Figure 3A:
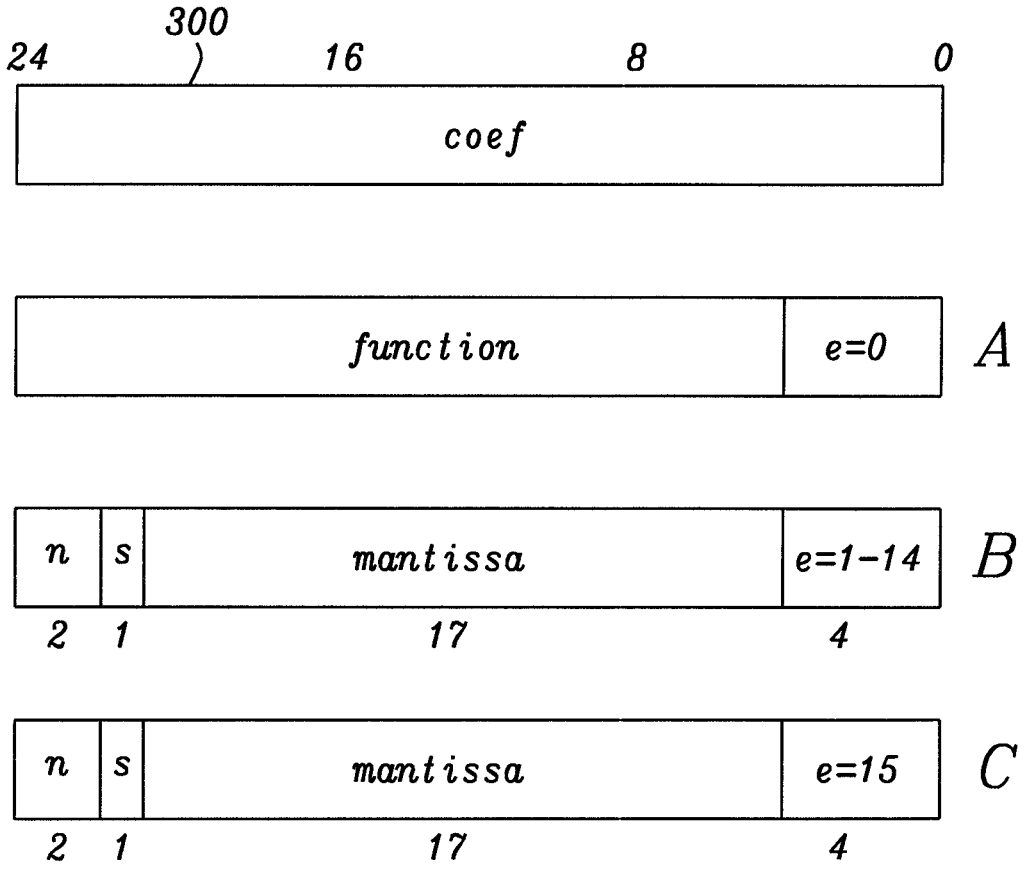

FIG. 3A shows examples of an encoded format for the digital value 202. In the present example, the digital value 202 comprises 24 bits, as shown by a general example 300. The encoded format in the present example uses base two. In the present example, and as discussed previously, no bits are required to represent the base.

The encoded format illustrated in FIG. 3A may be referred to as the delta 4.2.18 coefficient format. It uses 4 bits to encode an exponent, 2 bits to encode an integer, 18 bits to encode the fractional part (1 bit to encode a sign, provide by the sign bit, and 17 bits to encode a mantissa). Depending on the value of the exponent, different encoding variants may be used.

For example A, for offset values ranging from −0.5 to 0.5, the fractional part (labelled "fraction" in the Figure) is represented as Q0.20 using the 20 top bits of the floating point representation of the offset. The offset may be referred to as the delta coefficient, as discussed previously, and with reference to equation (12).

It will be appreciated that Q0.20 is an example of a Q number format which will be well known the skilled person. There is 0 bits representing the integer, and 20 bits representing the fractional part.

Example B relates to offset values ranging from −0.25 to 0.25. The exponent can range from 1 to 14 and is represented by the four least significant bits. The exponent is used to shift down the fractional part. The exponent is labelled as e=1−14 in the Figure. There are two integer bits (being the two most significant bits of the coefficient and denoted "n"), representing −2, −1, +1, +2. There is provided 18 fractional bits: sign s (1 bit, being the sign bit) with mantissa m (17 bits), representing values between −0.25 and +0.25. The fractional part may be decoded as s.$\bar{s}$mmmmmmmmmmmmmmmmm. The $\bar{s}$ means inverted s so if s=1, then $\bar{s}$=0.

Example C is the same as described for Example B, but with an exponent of 15. The fractional part is decoded as s.mmmmmmmmmmmmmmmmm.

FIG. 3B illustrates how the bits forming the offset is decoded. The left hand side shows decoded offsets for exponent values ranging from 0 to 15, and a sign bit equal to zero. The right hand side shows decoded offsets for exponent values ranging from 0 to 15, and a sign bit equal to one.

Decoding of a digital value 202 of 24 bits results in a decoded coefficient value of Q3.32.

By way of explaining the Q notation in this example, the 3 denotes that three bits are required to represent an integer having a value of −2, −1, +1 or +2, which is represented by two bits prior to decoding. Furthermore, the offset is added/subtracted from these integer bits. So the final range is about −2.5 . . . +2.5, which requires 3 integer bits. 32 denotes that thirtytwo bits are required to represent the offset after decoding.

The following is provided as an example. Assume that we wish to represent an integer of +1 and an offset of (fractional part$\times 2^{-15}$). As discussed previously, using the present 24 bit digital value format, the integer may be represented by 2 bits. The exponent of 15 would be represented by 4 bits. The fractional part, in this example is represented by 18 bits, with a single bit being the sign bit and 17 bits being the mantissa.

We may assume a fractional part having a value of 0.1110001110001110 1, after decoding, where the 0 before the "." is the sign bit s, and the bits after the "." denote the mantissa. The decoded offset is then as follows: 0.00000000000000011100011100011101. In the present example, the decoded digital value 202 uses 35 bits, whereas the encoded value only uses 24 bits.

Figure 4:
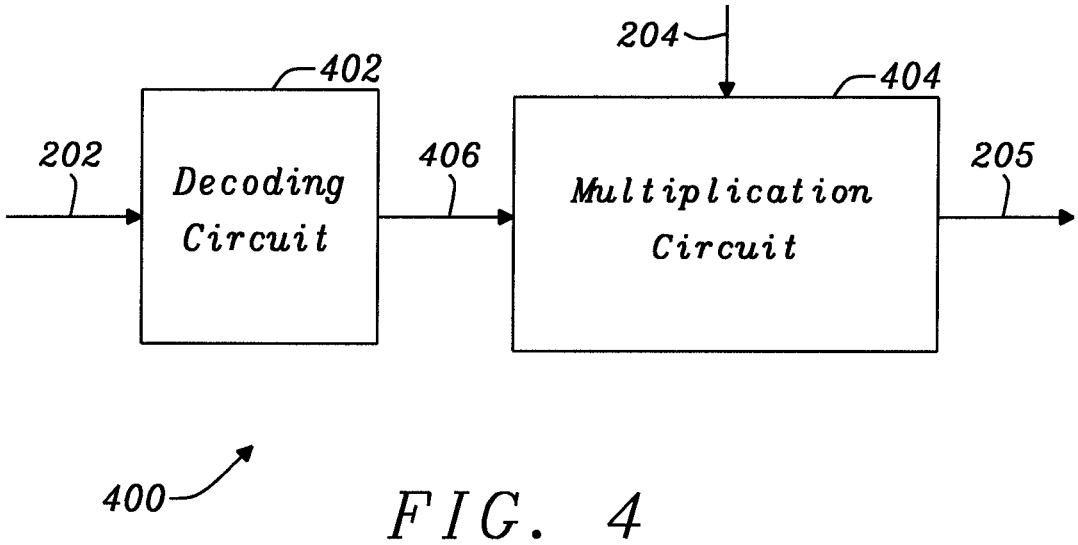
FIG. 4 is a schematic of a digital signal processing system in accordance with a second embodiment of the present disclosure.

FIG. 4 is a schematic of a digital signal processing system 400 in accordance with a second embodiment of the present disclosure. The digital signal processing system 400 is a specific embodiment of the digital signal processing system 200 and may use the encoded format as described in relation to the digital signal processing system 200, in accordance with the understanding of the skilled person. Common reference numerals and variables between Figures denote common features.

The digital signal processing system 400 comprises a decoding circuit 402 configured to receive the digital value 202 in the encoded format and to decode the digital value 202 prior to multiplication. The digital value 202 may have the encoded format as described previously and be decoded as described previously, for example with reference to FIGS. 3A and 3B, and the accompanying description. In further embodiments, the encoded format may differ from the previous description and/or may be decoded using another method, in accordance with the understanding of the skilled person.

The digital signal processing system 400 further comprises a multiplication circuit 404 configured to receive the digital value 202 in a decoded format 406 and to multiply the digital value 202 in the decoded format 406 with the digital signal 204.

Figure 5:
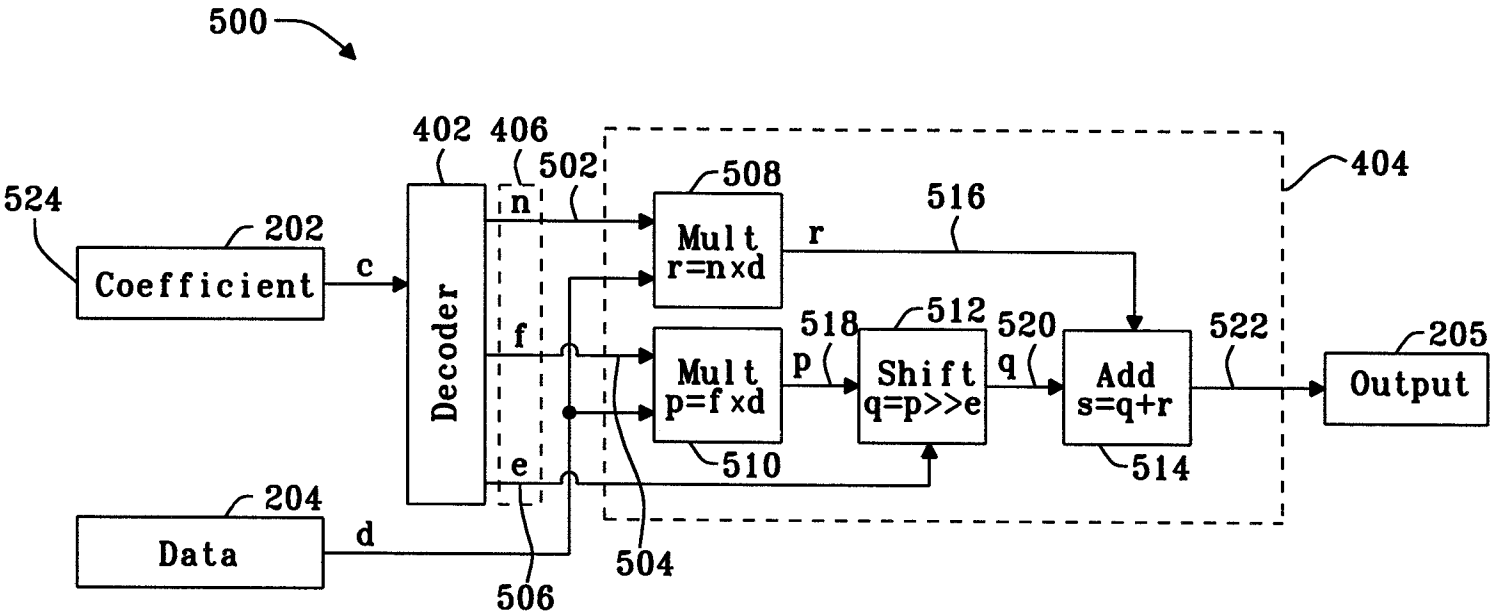
FIG. 5 is a schematic of a digital signal processing system in accordance with a third embodiment of the present disclosure.

FIG. 5 is a schematic of a digital signal processing system 500 in accordance with a third embodiment of the present disclosure. The digital signal processing system 500 is a specific embodiment of the digital signal processing system 400 and may use the encoded format as described in relation to the digital signal processing system 200, in accordance with the understanding of the skilled person. Common reference numerals and variables between Figures denote common features.

The digital value 202 in the decoded format 406 may comprise a component 502 comprising the integer, a component 504 comprising the fractional part and a component 506 comprising the exponent. The decoding circuit 402 is configured to provided the digital value 202 in the decoded format 406 by providing the components 502, 504, 506, each in their decoded formats.

In an embodiment where the digital value 202 in its encoded format does not include a bit, or bits, representing the integer, for example when the integer is intended to have a fixed value such as zero, the decoding circuit 402 may still provide the component 502 representing the integer. For example, this component may be generated based on an integer value stored in a memory element or otherwise provided to the decoding circuit 402. Alternatively, upon receiving a digital value 202 not having bits relating to the integer, the decoding circuit 402 may be configured to provide a pre-set component 502 in response.

It will be appreciated that in further embodiments where the digital value 202 does not comprise bits representing an integer, the multiplier 508 may be configured to operate based on a default integer value, such as zero, which may for example be stored and then provided by a memory element, or may otherwise provided to the multiplier 508 in accordance with the understanding of the skilled person.

The multiplication circuit 404 may comprise a multiplier 508 configured to receive the component 502 and the digital signal 204, a multiplier 510 configured to receive the component 504 and the digital signal 204, and a shifter circuit 512 configured to receive the component 506.

The shifter circuit 512 will "re-align" the bits that it receives. For example, applying a shift up by two operation on 001001 will yield 100100. In the present case, the shifter circuit 512 acts to shift the value for the fractional part by the value of the exponent.

The multiplication circuit 404 may further comprise an addition circuit 514. The multiplier 508 may be configured to multiply the component 502 and the digital signal 204 and to provide an output 516 to the addition circuit 514. The output 516 is the product of the multiplication of the component 502 and the digital signal 204.

The multiplier 510 may be configured to multiply the component 504 and the digital signal 204 and to provide an output 518 to the shifter circuit 512. The output 518 is the product of the multiplication of the component 504 and the digital signal 204.

The shifter circuit 512 may be configured to shift the output 518 using the component 506 and to provide an output 520 to the addition circuit 514. The output 520 is the output 518 shifted using the component 506.

The addition circuit 514 may be configured to add the output 516 and the output 520 to provide an output 522, the output 522 being the sum of the outputs 516, 520 which is the product 205 of the multiplication of the digital value 202 and the digital signal 204.

The digital signal processing system 500 may comprise a memory element 524 configured to store the digital value 202 in the encoded format.

The digital processing system 500 of FIG. 5 shows a possible hardware realization for a multiplication circuit that supports the encoded format as described herein. In operation, the decoder 402 obtains the integer and offset from the encoded coefficient word (the digital value 202). The decoded digital value 202 is then processed by the multipliers 508, 510, shifter circuit 512 and addition circuit 514 to provide the product 205 at an output. In summary, the multiplication circuit provided by the digital processing system 500 multiples the digital signal 204 with the decoded coefficient provided by the digital value 202.

Figure 6:
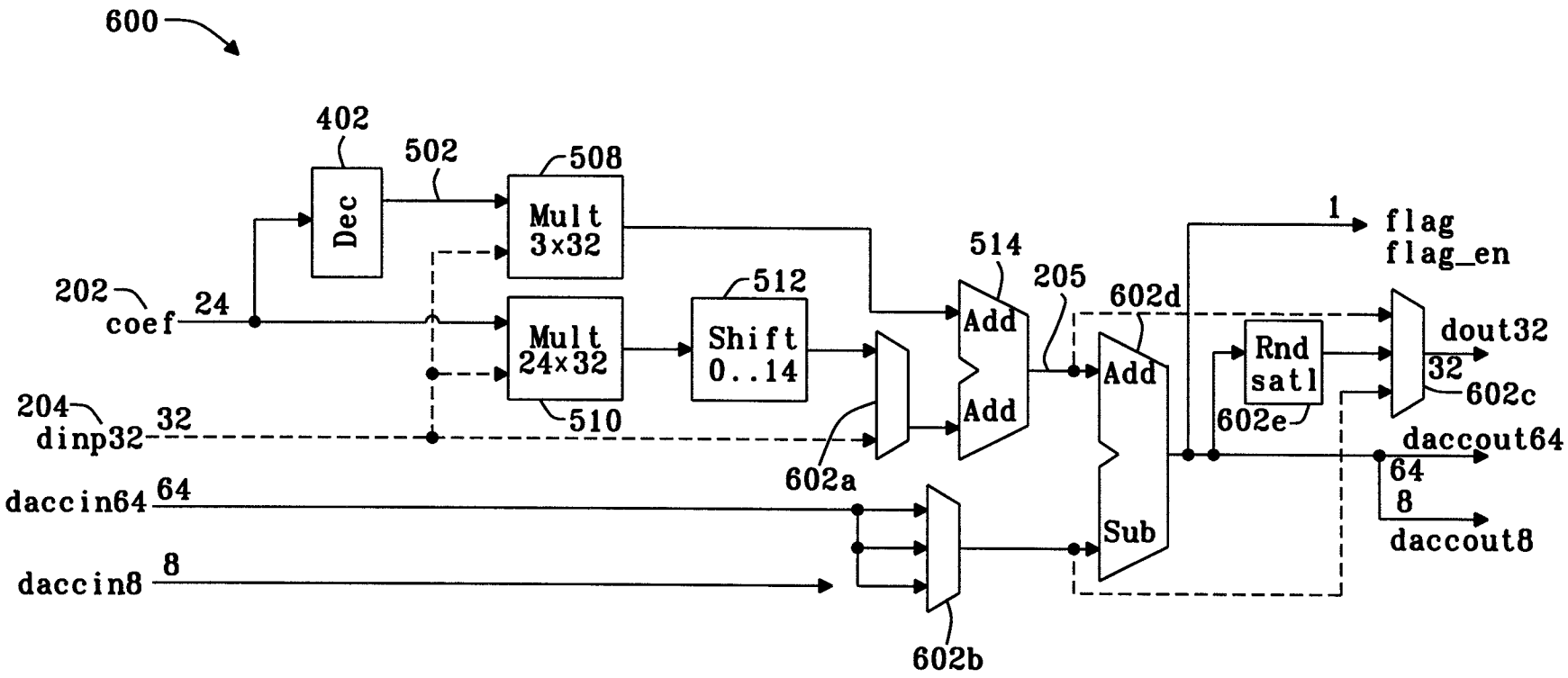
FIG. 6 is a multiply accumulate unit comprising the digital signal processing system of FIG. 5 in accordance with a fourth embodiment of the present disclosure.

FIG. 6 is a multiply accumulate unit 600 comprising the digital signal processing system 500 in accordance with a fourth embodiment of the present disclosure. It will be appreciated that in a further embodiment the digital signal processing system 500 may be the digital signal processing system 200, the digital signal processing system 400 or any of the digital signal processing systems 200, 400, 500 described herein and incorporating any of the features described herein, in accordance with the understanding of the skilled person. FIG. 6 illustrates how the delta coefficient multiplication of the present disclosure may be integrated with a conventional 24×32 multiply accumulate unit. The 24×32 multiplier (multiplier 510 in the present example) may be shared with the conventional multiply accumulate unit. The multiply accumulate unit 600 further comprises components 602*a*, 602*b*, 602*c*, 602*d*, 602*e*. The components 602*a*, 602*b*, 602*c* may be multiplexer circuits, the component 602*d* may be an addition circuit and the component 602*e* may be a shifter circuit.

Figure 7:
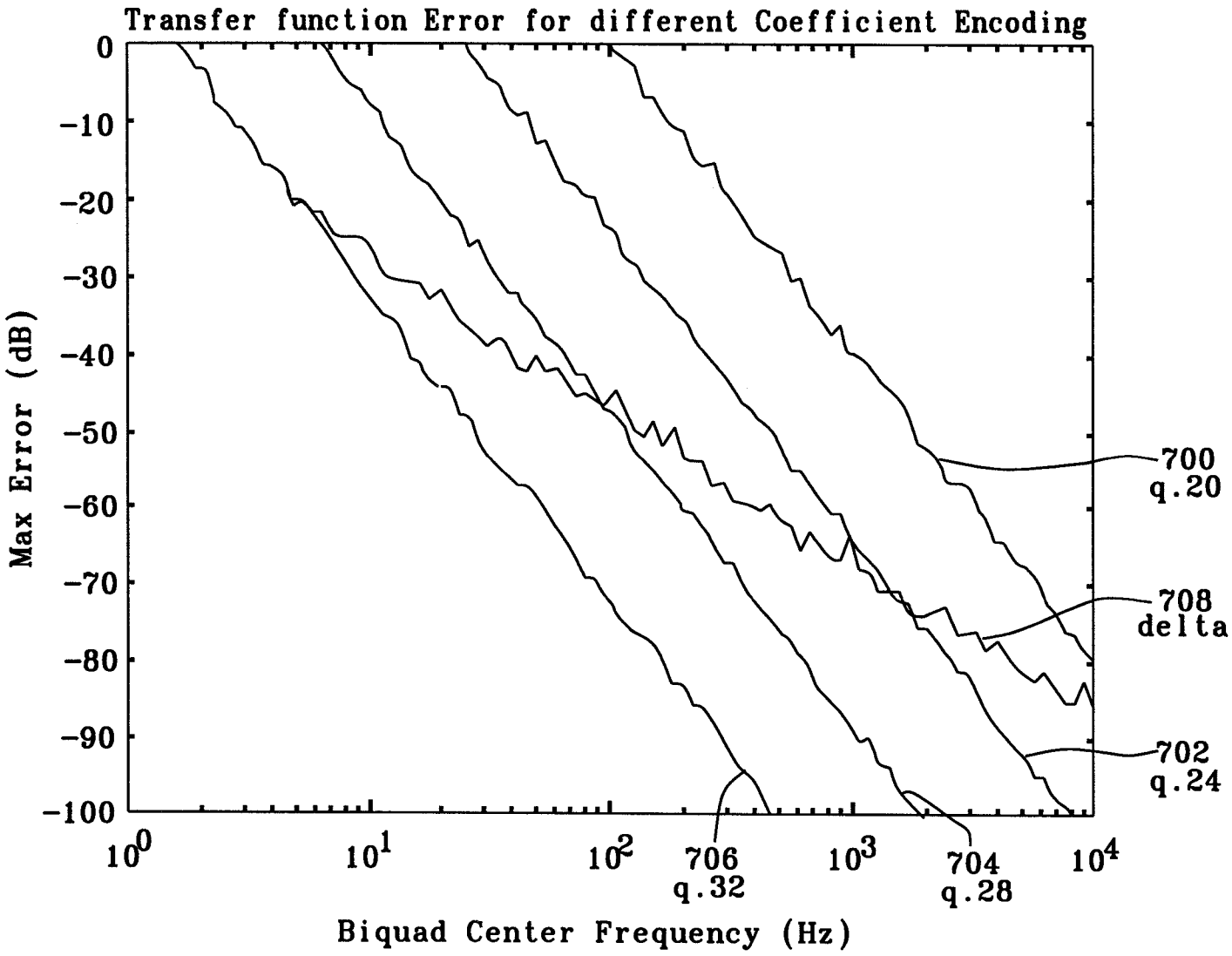
FIG. 7 shows simulation results showing the transfer function errors for different coefficient encoding.

FIG. 7 shows simulation results showing the transfer function errors for different coefficient encoding. There q.xx traces show the worst case transfer function errors for conventional fixed point precision coefficients (xx denotes the bits for the offset). The following traces are shown: a trace 700 for q.20; a trace 702 for q.24; a trace 704 for q.28; a trace 706 for q.32. The delta trace (a trace 708) shows the precision of the method of using floating point representation for the offset as disclosed herein.

FIG. 7 demonstrates that the delta encoding of the present disclosure is capable of delivering up to 32 bit fractional precision.

Figure 8:
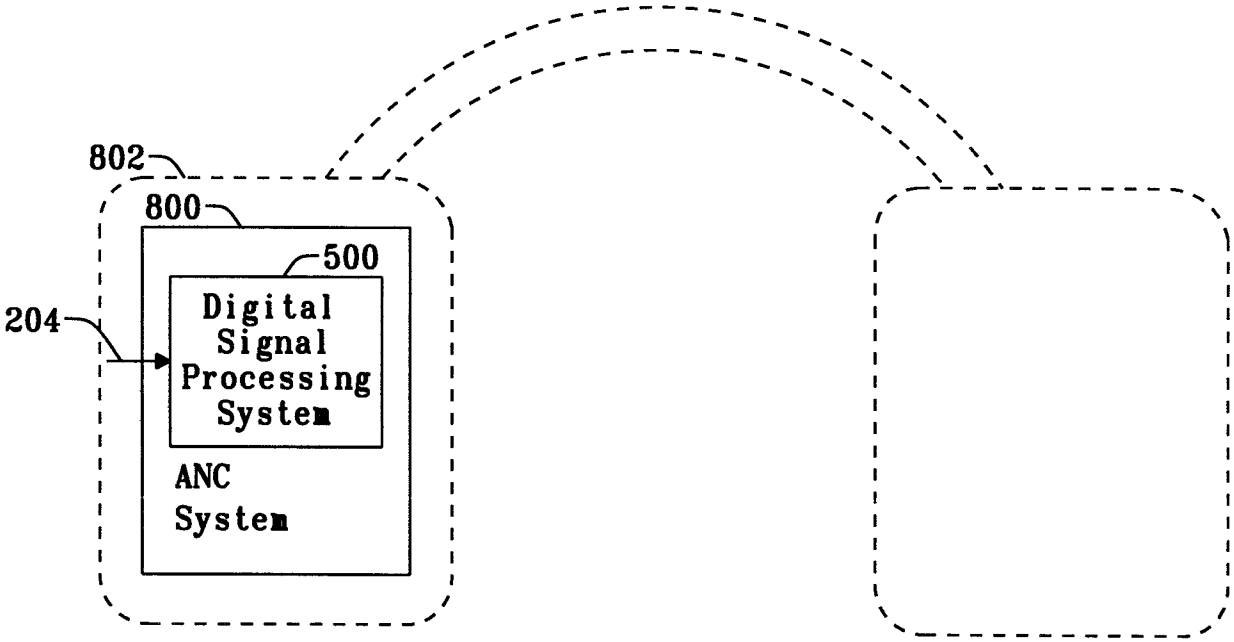
FIG. 8 is a schematic of an active noise cancellation (ANC) system comprising the digital signal processing system of FIG. 5 in accordance with a fifth embodiment of the present disclosure.

FIG. 8 is a schematic of an active noise cancellation (ANC) system 800 comprising the digital signal processing system 500 in accordance with a fifth embodiment of the present disclosure. It will be appreciated that in a further embodiment the digital signal processing system 500 may be the digital signal processing system 200, the digital signal processing system 400 or any of the digital signal processing systems 200, 400, 500 described herein and incorporating any of the features described herein, in accordance with the understanding of the skilled person.

In the present embodiment, the digital signal 204 may be an audio signal. The ANC system 800 may be implemented within a headset 802.

In a specific embodiment, the multiplication provided by the digital signal processing system 500 may be provided as part of a biquad filter. As will be clear to the skilled person it is possible to create anti-noise and perform ANC with a series of biquad filters, where, for example, one or more of said biquad filters comprises the digital signal processing system 500. As such, the ANC system 800 may comprise a plurality of biquad filters, where at least one of the biquad filters comprises the digital signal processing system 500.

The digital signal processing systems described herein provide a specialized multiplication unit that is optimized for filtering data streams, has a lower area than known systems, lower complexity than known systems and hence lower power compared to a conventional full precision multiply accumulate unit.

The coefficients (the digital values 202) are encoded into a words length that is smaller than a full precision equivalent, thereby saving memory area and power usage.

Compared to known systems which require two multiplications in order to perform high precision arithmetic, there is a reduction in cycles and hence memory and power by more than a factor two. Therefore, the power and memory savings is 50%.

Compared to a dedicated 32×32 multiplier, the use of the encoded format described herein (which may be referred to as delta encoding or delta coefficient encoding) with a 32×24 multiplier results in a 25% reduction in power and memory.

Various improvements and modifications may be made to the above without departing from the scope of the disclosure.

What is claimed is:

1. A digital signal processing system for multiplying a digital value and a digital signal, the digital signal processing system configured to:

receive the digital value in an encoded format; and:

multiply the digital value with the digital signal; wherein:

the digital value in the encoded format comprises twenty four bits and an offset, the offset being encoded as a floating point.

2. The digital signal processing system of claim 1, wherein a base of the floating point is two.

3. The digital signal processing system of claim 1, wherein the floating point comprises a fractional part and an exponent.

4. The digital signal processing system of claim 3, wherein the fractional part comprises a sign bit and a mantissa.

5. The digital signal processing system of claim 4, wherein:

the exponent comprises four bits; and/or the fractional part comprises twenty bits.

6. The digital signal processing system of claim 1, wherein the digital value in the encoded format comprises an integer.

7. The digital signal processing system of claim 6, wherein the integer comprises two bits.

8. The digital signal processing system of claim 7, wherein:

the floating point comprises a fractional part and an exponent; and the exponent comprises four bits and/or the fractional part comprises eighteen bits.

9. The digital signal processing system of claim 1, comprising:

a decoding circuit configured to i) receive the digital value in the encoded format; and ii) decode the digital value prior to multiplication; and a multiplication circuit configured to:

i) receive the digital value in a decoded format; and ii) to multiply the digital value in the decoded format with the digital signal.

10. The digital signal processing system of claim 9, wherein the floating point comprises a fractional part and an exponent.

11. The digital signal processing system of claim 10, wherein the digital value in the encoded format comprises an integer.

12. The digital signal processing system of claim 11, wherein the decoding circuit is configured to provide the digital value in the decoded format by providing:

a first component comprising the integer in the decoded format;

a second component comprising the fractional part in the decoded format; and a third component comprising the exponent in the decoded format.

13. The digital signal processing system of claim 12, wherein the multiplication circuit comprises:

a first multiplier configured to receive the first component and the digital signal;

a second multiplier configured to receive the second component and the digital signal; and a shifter circuit configured to receive the third component.

14. The digital signal processing system of claim 13, wherein the multiplication circuit comprises an addition circuit, wherein:

the first multiplier is configured to multiply the first component and the digital signal and to provide a first output to the addition circuit;

the second multiplier is configured to multiply the second component and the digital signal and to provide a second output to the shifter circuit;

the shifter circuit is configured to shift the second output using the third component and to provide a third output to the addition circuit; and the addition circuit is configured to add the first output and the third output to provide a fourth output, the fourth output being the multiplication of the digital value and the digital signal.

15. The digital signal processing system of claim 1 wherein the digital signal comprises thirty two bits.

16. The digital signal processing system of claim 1 comprising a memory element configured to store the digital value in the encoded format.

17. The digital signal processing system of claim 1 configured to processes digital signal at an oversampled rate.

18. A multiply accumulate unit comprising a digital signal processing system for multiplying a digital value and a digital signal, the digital signal processing system configured to:

receive the digital value in an encoded format; and multiply the digital value with the digital signal; wherein:

the digital value in the encoded format comprises twenty four bits and an offset, the offset being encoded as a floating point.

19. An active noise cancellation system comprising a digital signal processing system configured as a noise cancelling filter, the digital signal processing system for multiplying a digital value and a digital signal wherein the digital signal is an audio signal, the digital signal processing system configured to:

receive the digital value in an encoded format; and:

multiply the digital value with the digital signal; wherein:

the digital value in the encoded format comprises an offset, the offset being encoded as a floating point.

20. The active noise cancellation system of claim 19, wherein the active noise cancellation system is implemented within a headset.

21. A method for multiplying a digital value and a digital signal using a digital signal processing system, the method comprising:

receiving the digital value in an encoded format using the digital signal processing system; and:

multiplying the digital value with the digital signal using the digital signal processing system; wherein:

the digital value in the encoded format comprises twenty four bits and an offset, the offset being encoded as a floating point.

* * * * *